United States Patent [19]

Onembo

[11] 4,091,754

[45] May 30, 1978

[54] LOOPER THROW-OUT MECHANISM FOR SEWING MACHINE

[75] Inventor: Eli N. Onembo, Clark, N.J.

[73] Assignee: The Singer Company, New York, N.Y.

[21] Appl. No.: 778,209

[22] Filed: Mar. 16, 1977

[51] Int. Cl.[2] ..... D05B 57/02

[52] U.S. Cl. ..... 112/200

[58] Field of Search ..... 112/199, 200, 197, 198, 112/159

[56] References Cited

U.S. PATENT DOCUMENTS

| | | | |
|---|---|---|---|
| 1,915,923 | 6/1933 | Clayton | 112/200 |
| 4,044,699 | 8/1977 | Marforio | 112/200 |

FOREIGN PATENT DOCUMENTS

| | | | |
|---|---|---|---|
| 75,855 | 9/1973 | Japan | 112/200 |

*Primary Examiner*—Werner H. Schroeder
*Assistant Examiner*—Peter Nerbun
*Attorney, Agent, or Firm*—Alan Ruderman; Edward L. Bell; Robert E. Smith

[57] ABSTRACT

A chain stitch sewing machine with a looper having an eye adapted for carrying thread and cooperating with at least one reciprocating needle as the looper oscillates and rocks in its operative position. The looper is supported on a looper carrier including a shaft journaled in an eccentric bore of a bushing which in turn is journaled in the bed of the sewing machine. A looper throw-out means is provided for bodily moving the looper out of its operative position for threading. The throw-out means includes a bushing support block receiving the bushing and pivotably supports a swinging latch member. The latch member includes a locking member adapted to be received within a socket member on the bed to prevent undesirable rotation of the support block, and further includes a resilient latching finger for gripping the support block to retard pivoting of the latch member when the looper is in its operative position. When it is desired to thread the looper the swinging latch member is pivoted upwardly to release the resilient finger from the block and the locking member from the bed and is then turned to rotate the support block including the looper bushing to bodily swing the looper to the threading position.

8 Claims, 3 Drawing Figures

LOOPER THROW-OUT MECHANISM FOR SEWING MACHINE

BACKGROUND OF THE INVENTION

This invention relates to chain stitch sewing machines of the type having thread carrying loopers and more particularly for mechanism to throw the looper away from its normal operating position so as to be readily available for convenient threading.

In some chain stitch sewing machines, a looper usually with an eye near its point is designed to carry a lower thread through the loop of the needle thread which is formed beneath the fabric. This action of the looper enables the needle thread loop to enclose a lower thread in the formation of the chain stitch. Because of the action of the looper relative to the needle, and the normal operative position of the looper, it is extremely difficult to thread the looper unless it is moved to a retracted position.

Mechanisms for retracting the looper to threading position by bodily moving the looper carrier as distinguished from a mere pivotable movement of the looper carriers, are known in the prior art. Also known in the prior art for accomplishing this, is mechanism consisting of an eccentric bushing supporting the stud shaft of the looper carrier so that when the bushing is turned, the looper carrier and looper are bodily moved out of the normal operating position into a convenient threading position. Examples of this construction are illustrated in U.S. Pat. Nos. 1,915,923 and 2,397,336.

With the higher speeds attainable by present day sewing machines, it has been found necessary to securely lock the bushing relatively to the frame so as to prevent undesirable movement of the looper from its normal operating position while the sewing machine is operating. Japanese Utility Model No. 75855/73 illustrates a chain stitch sewing machine having an oscillating looper which moves along the line of feed and includes an eccentric member which can be used for moving the looper out of the normal operating position and into a threading position, and has a knob and a detent pin for locking the loopers in the operating position.

SUMMARY OF THE INVENTION

The present invention provides an improvement over the known looper throw-out mechanisms by providing an improved arrangement for turning the bushing and the looper into the threading position and for locking the looper in the operative position. To this end, the present invention provides a bushing support block secured to the bushing and a pivotable grasping member journaled on the support block, so as to turn the support block about the axis of the bushing. The grasping member includes a sheet metal locking bolt adapted to be received within a socket member on the bed of the sewing machine to prevent rotation of the support block, and a resilient latching finger adapted to grip the support block to prevent undesirable pivoting of the grasping member. When it is desirable to thread the looper, the grasping member is pulled and pivoted so as to release the latching finger and simultaneously release the locking bolt from the socket; it may thereafter be rotated to bodily move the looper to the threading position. Since the grasping member, the locking member and the resilient latching finger are constructed of sheet metal, the mechanism is inexpensive to manufacture in comparison to the known prior art.

It is therefore a primary object of the present invention to provide an improved inexpensive looper throw-out mechanism for a chain stitch sewing machine having a threadable looper.

It is another object of the present invention to provide a locking device for a looper throw-out mechanism to prevent undesirable bodily movement of the looper during normal sewing operation.

BRIEF DESCRIPTION OF THE DRAWINGS

The particular features and advantages of the present invention as well as other objects will become apparent from the following description taken in connection with the accompanying drawings, in which.

DESCRIPTION OF THE PREFERRED EMBODIMENT

Figure 1:
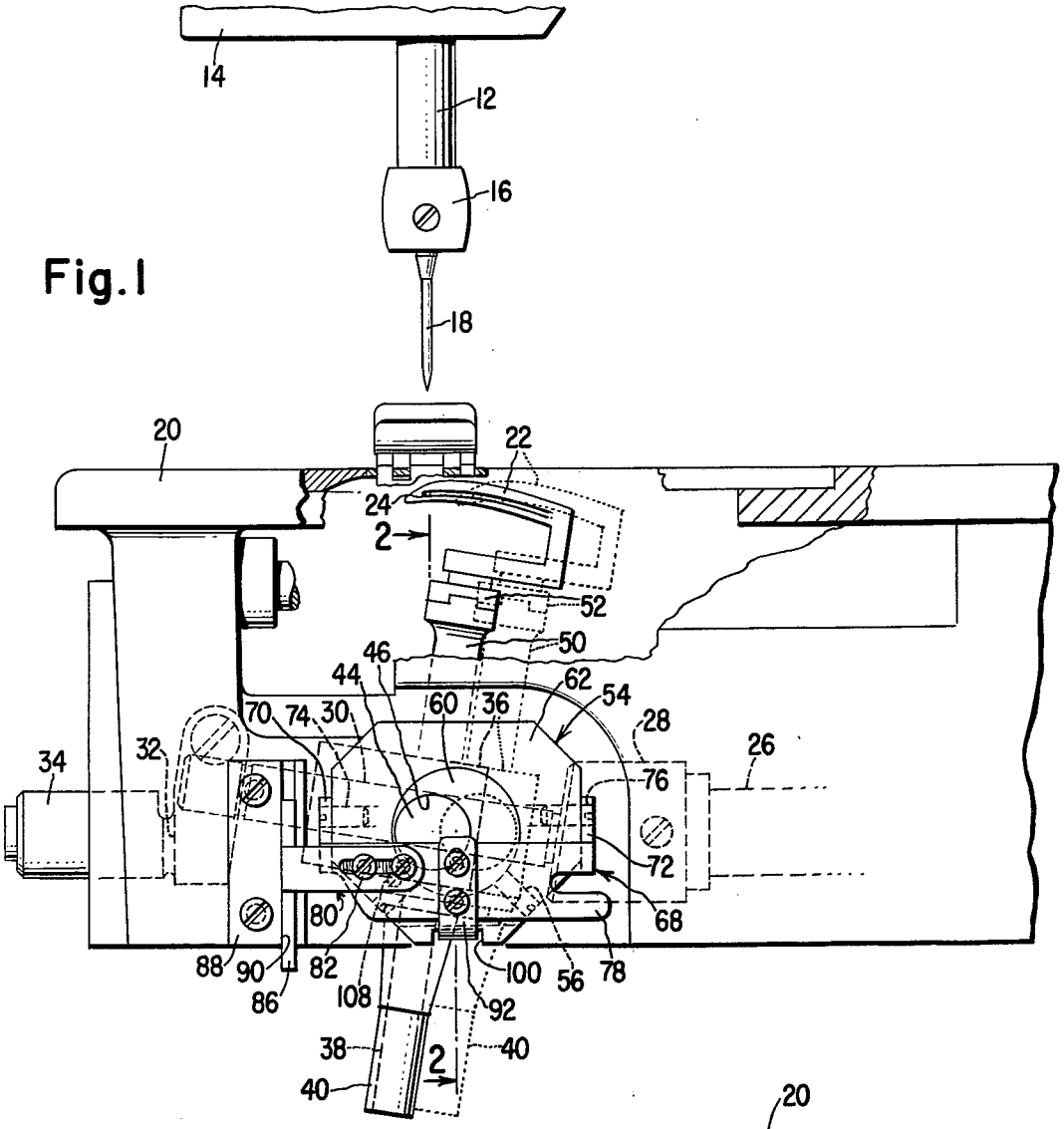
FIG. 1 is a front elevational view of a portion of a sewing machine incorporating the improved looper throw-out mechanism with parts of the machine broken away and cross-sectioned for clarity, and the phantom lines illustrating the throw-out mechanism in the threading position.
Figure 2:
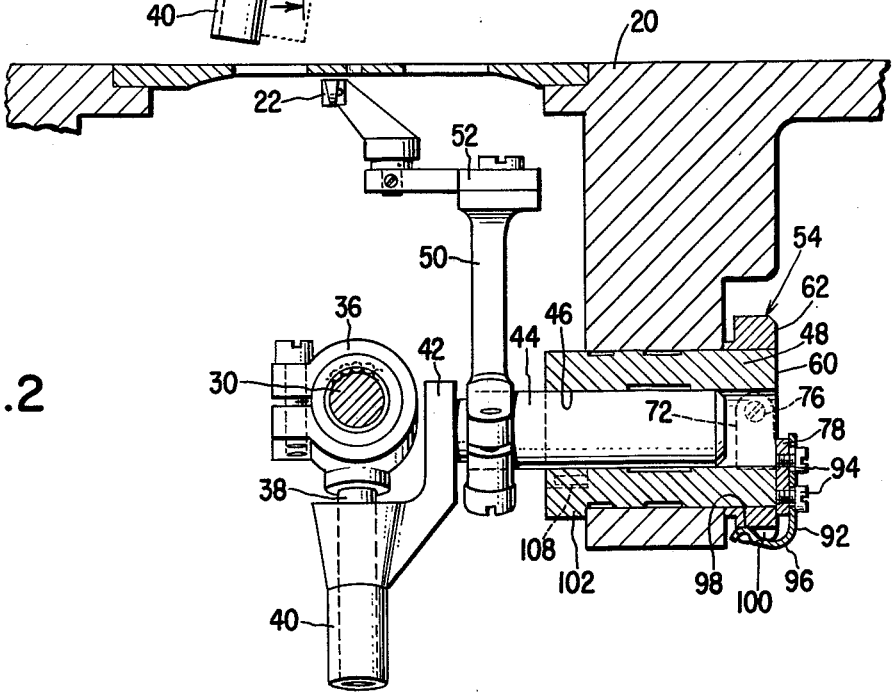
FIG. 2 is a cross-sectional view taken substantially along line 2—2 of FIG. 1.
Figure 3:
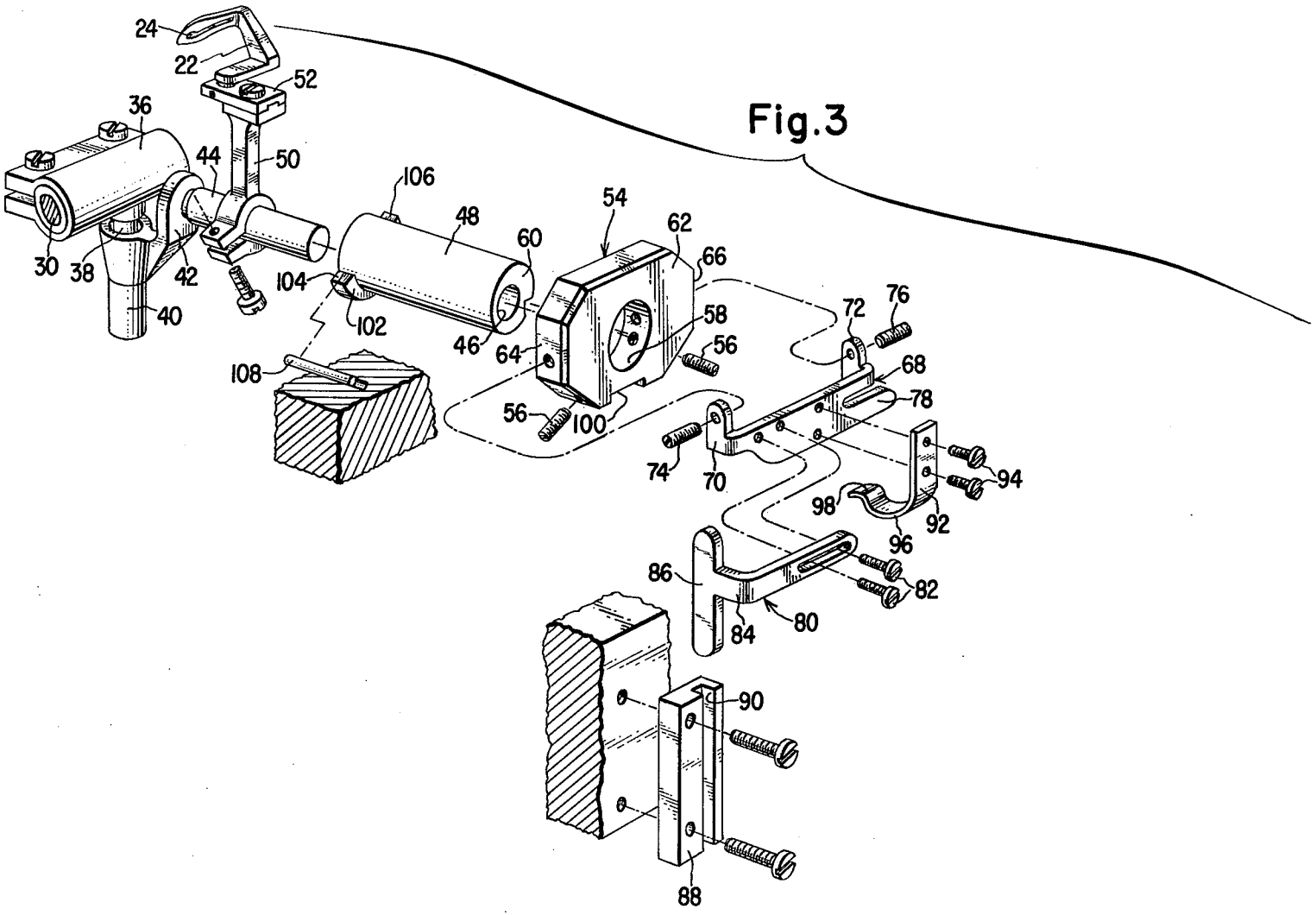
FIG. 3 is a disassembled perspective view of the looper throw-out and locking mechanism of the invention.

Referring to the drawings, FIG. 1 illustrates a portion of a chain stitch sewing machine having a reciprocating needle bar 12 mounted for reciprocation within a sewing head 14 and carrying at its lower end a needle clamp 16 which in turn carries at least one needle 18. Mounted in a bed 20, beneath the needle bar is a looper 22 driven by conventional means into cooperation with the needle to conventionally form chain stitches. The illustrated machine is a two thread chain stitch machine for forming FEDERAL STITCH TYPE 401 whereby a single threaded needle cooperates with a threaded looper, but the invention is applicable to other threaded looper machines, such as for example, three thread (two needles, one looper) FEDERAL STITCH TYPE 402, etc. The looper 22, therefore includes a threadable eye 24. In the particular embodiment the looper is driven with a motion that partakes of ocillatory and rocking motion so as to oscillate along the line of feed and includes an avoiding motion across the line of feed as is conventional in machines of this type.

In order to drive the looper in the required motion, a rotary looper drive shaft 26 is conventionally driven by motor means not shown, and includes a looper driving crank shaft 28 which may be adjustable to adjust the amount of avoid between the looper and the needles. Secured to the crank 28 is a drive pin 30 which supports the loopers as hereinafter described and which is secured to a hub of a crank 32 of a drive shaft stud 34 journaled in the bed of the machine. Clamped about the crank pin 30 is a coupling sleeve 36 having a downwardly dependent pin 38 rigid therewith. The pin is journally received within the bore of a sleeve 40 forming one portion of a three portion looper carrier, having a second portion 42 extending radially from the upper part of sleeve and projecting upwardly substantially parallel to the sleeve portion and having a rigid shaft 44 disposed outwardly from a face thereof and substantially normal to the axis of the coupling portion 40. The shaft 44 is journaled for oscillation and translation within the bore 46 of a bushing 48. Clamped on the shaft 44 between the bushing and the portion 42 of the carrier is a looper bar 50 which extends upwardly and carries at its upper end the base 52 on which the looper 22 is attached. Thus the looper 22 partakes of the motion of the stud shaft 44 which comprises an oscillatory motion along the line of feed as the shaft 44 oscillates within the bore 46 and a rocking motion as the shaft 44 slides within the bore 46. Thus far, what has been described is conventional. Because of the limited room beneath the needle, when it is desired or necessary to thread the looper eye 24, it is also conventional to bodily move the looper out of its normal operating position illustrated by the solid lines in FIG. 1 to a more convenient position as illustrated by the phantom lines in FIG. 1. To this end, one approach in the prior art has been to offset the bore 46 from the center line of the bushing 48 so that it is eccentric thereto and to rotate the bushing to move the shaft 44 and thus the looper to the phantom position.

In order to conveniently accomplish the above result, and to securely lock the bushing and the looper in its operative position, the present invention provides a bushing support block 54 within which the bushing 48 may be secured as by set screws 56 or the like, and means to be described for turning the looper support block and for securely locking the same to the bed of the sewing machine. The bushing 48 is received within a bore 58 of the support block, with a front face 60 of the bushing substantially planar with the front face 62 of the support block. The support block includes a pair of substantially planar radially spaced surfaces 64 and 66 to which a pivotable grasping tab 68 having a pair of upstanding ears 70 and 72 is pivotally secured by means of respective stud screws 74 and 76. The grasping member 68 includes a grasping finger 78 conveniently located in the bed of the sewing machine for manipulation by an operator. The grasping tab 68 is preferably inexpensively manufactured by a stamping process from sheet metal. When it is desired to thread the looper, the grasping tab 68 is pivoted upwardly out of the plane of the face 62 of the block 54 and rotated clockwise as illustrated in FIG. 1 to turn the block together with the bushing 48 and the looper as previously described.

In order to secure the block 54 in the operative position of the looper, a locking member in the form of a stamped sheet metal member 80 is secured to the front face of the grasping member by means of screws 82. The member 80 includes a 90 degree bend at 84 and includes an elongated upstanding ear 86 extending substantially parallel to the axis of the bushing 48. Mounted on the bed adjacent to the location of the block 54 is a locking block 88 having an elongated slot or groove 90 extending substantially normal to the pivot axis of the grasping tab 68 when the latter is in the operative position of the looper. The slot 90 is sized so as to receive the ear 86 when the grasping tab 68 is positioned against the face 62 of the bushing support block 54. Thus in the operative position of the looper 22, the ear 86 is positioned within the slot 90 and prevents undesirable turning of the support block 54. It can only be disengaged from the slot 90 when the grasping tab 68 is pivoted away from the face 62.

In order to prevent undesirable pivoting of the grasping tab from the face of the bushing support block 54, a sheet metal resilient latching finger 92 is secured to the grasping tab by means of screws 94 mounted adjacent to the locking member 80. The finger 92 has a substantial 90 degree bend at 96, so that in a normal operating position the finger underlays the support block 54. The finger also includes a bend at 98 displaced upwardly toward the block 54, so as to grip the block during the normal sewing operation. Preferably the block 54 includes a recess 100 at the bottom surface thereof for receiving the bent portion 98 of the finger 92.

In operation, when it is necessary to thread the looper, the tab 78 is grasped by an operator and pulled forwardly to release the finger 92 from the support block 54 and the ear 86 from the slot 90 as the grasping member 68 is pivoted substantially 90 degrees away from the front face 62 of the support block 54. The member 68 is then rotated approximately 180° to throw the looper to the phantom position shown in FIG. 1.

The bushing 48 may include an abutment stop member 102 having stop surfaces 104 and 106 spaced 180° apart. The member 102 may, as illustrated, be in the form of a semicircular annular member. A stopping pin 108 is positioned in the bed of the sewing machine and disposed for abutment with the member 102 at the surfaces 104 and 106. Thus, in the normal sewing position of the bushing 48 the surface 104 is in engagement with the pin 102 to limit the rotation of the bushing 48 for the looper to be in its proper operating position, and during the looper throw-out position the bushing 48 may be rotated until the surface 106 abuts the pin 108 to prevent further rotation and position the looper for convenient threading.

Numerous alterations of the structure herein disclosed will suggest themselves for those skilled in the art. It is to be understood that this disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In a sewing machine of the type comprising reciprocable needle means for cooperating with a looper having an eye adapted for carrying thread, the looper being supported in the machine on a looper carrier for oscillatory rocking movement in timed relationship with the needle means, said looper carrier including a shaft, and a bushing journaled in the bed and having an eccentric bore for receiving said shaft, the improvement comprising looper throw-out means for selectively rotating said bushing to bodily move said looper to a retractred position for threading and for locking said looper in the operative position, said looper throw-out means including a bushing support block secured to said bushing, a grasping member journaled on the support block for pivoting about an axis lying in a plane substantially normal to the axis of the bushing, said grasping member including a locking member having a locking bolt extending substantially parallel to and spaced from the axis of the bushing, and means defining a socket in the sewing machine for receiving said bolt and for restraining rotational movement thereof, whereby said support block is restrained against rotational movement until said grasping member is pivoted to release said bolt from the socket and thereafter the support block may be rotated to bodily move the bushing and looper to the retracted position.

2. In a sewing machine as recited in claim 1 wherein said grasping member includes a resilient latching finger for gripping the support block to retard pivoting of said grasping member relative to the block until released from the block.

3. In a sewing machine as recited in claim 2 wherein said support block includes a bore for receiving said bushing.

4. In a sewing machine as recited in claim 2, wherein said latching finger comprises a spring clip extending in the direction of the axis of said bushing and including a portion displaced toward said axis into abutment with the support block.

5. In a sewing machine as recited in claim 2, wherein said locking bolt comprises an elongated ear and said socket comprises a block secured to the sewing machine and having an elongated slot for receiving said ear when the looper is in the operative position.

6. In a sewing machine as recited in claim 4, wherein said support block includes a recess for receiving said spring clip.

7. In a sewing machine as recited in claim 2 wherein said bushing includes a pair of abutment means circumferentially spaced about the bushing, and a stop member positioned in said sewing machine disposed for engagement with a selective one or the other of said pair of abutment means to limit the extent of the rotational movement of said bushing and thereby said looper when the support block is rotated in each direction.

8. In a sewing machine as recited in claim 7 wherein said pair of abutment are spaced 180° apart.

* * * * *